US009362669B2

(12) United States Patent
Kim

(10) Patent No.: US 9,362,669 B2
(45) Date of Patent: Jun. 7, 2016

(54) OUTLET UNIT FACILITATING PLUG SEPARATION, AND MULTI-OUTLET DEVICE USING SAME

(71) Applicant: Oh Jung Kim, Gwangju (KR)

(72) Inventor: Gum-Kek Kim, Gwangju (KR)

(73) Assignee: Oh Jung Kim, Gwangju (KR)

( * ) Notice: Subject to any disclaimer, the term of this patent is extended or adjusted under 35 U.S.C. 154(b) by 0 days.

(21) Appl. No.: 14/409,018

(22) PCT Filed: Jan. 29, 2013

(86) PCT No.: PCT/KR2013/000692

§ 371 (c)(1),
(2) Date: Dec. 18, 2014

(87) PCT Pub. No.: WO2013/191350

PCT Pub. Date: Dec. 27, 2013

(65) Prior Publication Data

US 2015/0140845 A1 May 21, 2015

(30) Foreign Application Priority Data

Jun. 19, 2012 (KR) ..... 10-2012-0065510

(51) Int. Cl.
*H01R 13/62* (2006.01)
*H01R 13/633* (2006.01)
(Continued)

(52) U.S. Cl.
CPC ..... *H01R 13/633* (2013.01); *H01R 13/62933* (2013.01); *H01R 13/6335* (2013.01); *H01R 25/003* (2013.01); *H01R 13/4538* (2013.01)

(58) Field of Classification Search
CPC ..... H01R 13/633; H01R 13/6335; H01R 23/7005; H01R 23/7068; H05K 7/1409
USPC ..... 439/160, 152, 153, 155, 159
See application file for complete search history.

(56) References Cited

U.S. PATENT DOCUMENTS 1,775,564 A * 9/1930 Goodspeed ..... H01R 13/6335 439/160
2,051,425 A * 8/1936 Schlums ..... H01R 13/631 439/159

(Continued)

FOREIGN PATENT DOCUMENTS

EP 1274153 1/2003
JP 2007-149492 6/2007

(Continued)

OTHER PUBLICATIONS

International Search Report Dated May 29, 2013 From the Korean Intellectual Property Office Re. Application No. PCT/KR2013/000692 and Its Translation Into English.

*Primary Examiner* — Abdullah Riyami
*Assistant Examiner* — Vladimir Imas

(57) ABSTRACT

The present invention relates to an outlet unit facilitating plug separation and to a multi-outlet device using same. The outlet unit according to the present invention includes: an outlet main body having a plug inlet into which a plug is to be inserted, a bottom surface plate forming the bottom surface of the plug inlet and having a pair of terminal ports formed on the plate surface such that the terminals of a plug may be inserted, and a pair of electrodes which are disposed in the lower portion of the bottom surface plate and with which the terminals of the plug connect; a separation plate in which a pair of plug through-holes, through which the terminals of the plug pass, are formed on the plate surface and which is disposed in a raisable manner in the plug inlet so as to be capable of moving between a connection position, in which the terminals of the plug are lowered so as to be capable of being connected to the electrodes through the plug through-holes and the terminal ports, and a connection release position, in which the plug is lifted such that the terminals of the plug are separated from the electrodes; and a separation operation module which lifts the separation plate to the connection release position according to a user operation when the separation plate is placed in the connection position.

15 Claims, 9 Drawing Sheets

(51) Int. Cl.
*H01R 13/629* (2006.01)
*H01R 25/00* (2006.01)
*H01R 13/453* (2006.01)

(56) References Cited

U.S. PATENT DOCUMENTS 2,053,386 A * 9/1936 Wheeler ..... H01R 13/635 439/160
2,551,533 A * 5/1951 Gernheuser ..... H01R 13/633 174/66
2,571,046 A * 10/1951 Maisey ..... H01R 13/635 439/160
2,696,594 A * 12/1954 Harrington ..... H01R 13/633 439/160
2,817,825 A * 12/1957 Hallard ..... H01R 13/633 439/160
3,737,623 A * 6/1973 Vallone ..... F24C 15/104 174/51
3,926,494 A * 12/1975 Maillaro ..... H01R 13/4538 439/131
4,045,106 A * 8/1977 Borg ..... H01R 13/635 439/152
4,619,492 A * 10/1986 Corblick ..... H01R 13/62 439/153
4,973,255 A * 11/1990 Rudoy ..... H01R 13/62994 439/157
5,106,315 A * 4/1992 Billman ..... H01R 13/633 439/160
6,913,475 B2 * 7/2005 Hsu ..... H01R 13/6335 439/160
7,234,953 B2 * 6/2007 Chen ..... H01R 13/6335 439/152
8,083,531 B1 * 12/2011 Ourasanah ..... H01R 13/6335 439/159
8,226,423 B1 * 7/2012 Wu ..... H01R 13/633 439/160
2006/0211289 A1 * 9/2006 Chen ..... H01R 13/6335 439/159

FOREIGN PATENT DOCUMENTS

KR 10-0950600 5/2010
KR 20-0341326 2/2014
WO WO 2011/065622 6/2011
WO WO 2013/191350 12/2013

* cited by examiner

OUTLET UNIT FACILITATING PLUG SEPARATION, AND MULTI-OUTLET DEVICE USING SAME

RELATED APPLICATIONS

This application is a National Phase of PCT Patent Application No. PCT/KR2013/000692 having International filing date of Jan. 29, 2013, which claims the benefit of priority of Korean Patent Application No. 10-2012-0065510 filed on Jun. 19, 2012. The contents of the above applications are all incorporated by reference as if fully set forth herein in their entirety.

TECHNICAL FIELD

The present invention relates to an outlet unit facilitating plug separation and a multi-outlet device using the same, and more particularly, to an outlet unit facilitating plug separation and a multi-outlet device using the same that can be manufactured as an outlet unit while facilitating plug separation to facilitate manufacturing of the multi-outlet device constituted by two or more outlet units.

BACKGROUND ART

An outlet is connected with an electricity supply source supplied from an outdoor to receive power and serves to supply the received power to each destination indoors through each plug, and is manufactured in such a manner that plugs of various electric devices are inserted.

FIG. 1 is a diagram illustrating a configuration of a general outlet. Referring to FIG. 1, the general outlet 20 is constituted by an upper case 23 in which an insertion portion 25 is formed on the top and a lower case 21 coupled to the bottom of the upper case 23.

A connection port into which a connection pole 31 of a plug 30 connected to various electric devices is formed at the insertion portion 25 and a plurality of connection terminals (not illustrated) connected with the connection pole 31 of the plug 30 is provided inside the lower case 21.

When a user inserts the outlet 20 of the connection pole 31 into a connection hole ([0004] 21) of the outlet 20 with a handle 35, the connection pole 31 is connected with the connection terminal below the connection port 21 to connect the power, and as a result, such a connection state keeps significant closeness for preventing electric shock or preventing separation of the plug 30.

Therefore, when the user intends to separate the plug 30 from the outlet 20 after using the electric device in such a state, significant force is required.

In general, when the user intends to separate the plug 30 from the outlet 20, the user needs to pull the plug 30 with all his strength by using the other one hand while holding the outlet 20 with one hand. However, since the connection pole 31 and the connection terminal keep closeness, the plug 30 is not easily separated from the outlet 20 and in particular, housewives are apt to encounter electric shock while separating the plug 30 from the outlet 20 with hands wet with water.

DETAILED DESCRIPTION OF THE INVENTION

Technical Problem

Therefore, the present invention is contrived to solve the problem and an object of the present invention is to provide an outlet unit that facilitates plug separation.

Further, another object of the present invention is to provide a multi-outlet device that facilitates manufacturing the multi-outlet device constituted by two or more outlet units by an outlet connecting one plug as a unit.

In addition, yet another object of the present invention is to provide a multi-outlet device that facilitates manufacturing by simplifying a structure in manufacturing the multi-outlet device.

Means for Solving the Problem

The object is achieved by an outlet unit facilitating plug separation, including: an outlet main body having a plug inlet into which a plug is to be inserted, a bottom surface plate forming the bottom surface of the plug inlet and having a pair of terminal ports formed on the plate surface such that the terminals of a plug may be inserted, and a pair of electrodes which are disposed in the lower portion of the bottom surface plate and with which the terminals of the plug connect; a separation plate in which a pair of plug through-holes, through which the terminals of the plug pass, are formed on the plate surface and which is disposed in a raisable manner in the plug inlet so as to be capable of moving between a connection position, in which the terminals of the plug are lowered so as to be capable of being connected to the electrodes through the plug through-holes and the terminal ports, and a connection release position, in which the plug is lifted such that the terminals of the plug are separated from the electrodes; and a separation operation module which lifts the separation plate to the connection release position according to a user operation when the separation plate is placed in the connection position.

The separation operation module may include an operating lever having a plate contact portion contacting the bottom surface of the separation plate, a pivot axis portion pivotably installed in the outlet body, and a push contact portion at an opposite side to the plate contact portion with the pivot axis portion interposed therebetween, and a push button elevatably installed in the outlet body and pivoting the operating lever on the pivot axis portion by moving down the push contact portion so as for the plate contact portion to move up the separation plate in the connection release direction.

In addition, the outlet unit may further include a ground member grounding the plug at the time of connecting the plug, wherein the ground member may have a pair of ground portions exposed to an inner wall surface and to which the plug is grounded and a connection portion connecting the pair of ground portions below the bottom surface plate which are integrally formed in the plug through-hole.

Herein, the connection portion may extend in the longitudinal direction of the operating lever and a ground through-hole through which any one of the pair of ground portions passes may be vertically formed in the operating lever.

In addition, a lever through-hole through which the plate contact portion passes may be formed on the bottom surface plate so that the plate contact portion of the operating lever contacts the bottom of the separation plate.

Moreover, the outlet body may include the outlet body includes an upper body configured to include the plug through-hole and the bottom surface plate, and a lower body coupled to a lower portion of the upper body, and the pivot axis portion of the operating lever may be pivotably installed between the upper body and the lower body.

The outlet unit may further include a pair of elevation guide bars that extend toward the bottom surface plate from the separation plate; and an elevation guide grooves formed on the inner wall surface of the plug through-hole of the upper body and guiding elevation of the pair of elevation guide bars when the separation plate is elevated.

Meanwhile, the object may be achieved even by a multi-outlet device facilitating plug separation according to another embodiment of the present invention, including: the plurality of outlet units; an upper case having unit exposure holes through which the respective outlet units are exposed to the upper portion to correspond to the plurality of outlet units; and a lower case coupled with the upper case with being interposed among the plurality of outlet units to accommodate and support the plurality of outlet units, wherein a pair of electrodes applied to the respective outlet units are installed on a plate surface of the lower case.

Herein, the multi-outlet device may further include a pair of power line members installed in an installation direction of the plurality of outlet units to face the lower portions of the bottom surface plates of the plurality of outlet units, wherein n the pair of electrodes to be applied to each outlet unit may be formed in the pair of power line members, respectively.

In addition, each outlet unit may further include a pair of electrode coupling portions provided at the lower portion of the bottom surface plate and coupled with the pair of electrodes, respectively.

Further, each electrode may include a cylindrical electrode connection portion into which a terminal of the plug is inserted and which is electrically connected with the terminal of the plug while being inserted into the electrode insertion portion, and a pair of elastic coupling portions extending outward in a radial direction from the electrode connection portion to face each other, and each electrode coupling portion may include an electrode insertion hole having a cylindrical inner diameter, into which the electrode connection portion is inserted, and a coupling cutting portion formed by cutting one area of the electrode insertion hole and elastically engaged in the pair of electrode insertion holes when the electrode connection portion is inserted into the electrode insertion hole.

Herein, each electrode coupling portion may further include a line cutting portion formed by cutting one area of the electrode insertion hole, into which the power line member is inserted when the electrode connection portion is inserted into the electrode coupling hole.

Further, the plurality of outlet units may be disposed in a circular pattern, outer diameters of the upper case and the lower case may be provided in the circular pattern, and a cable winding portion for winding a power cable may be provided along the outer diameters of the upper case and the lower case.

In addition, the multi-outlet device may further include at least one cable pressing portion installed at least on one side of the upper case and the lower case to move inward and outward in the radial direction to press the power cable wound on the cable winding portion inward the radial direction.

Effect of the Invention

According to the present invention having such a configuration, an outlet unit facilitating plug separation and a multi-outlet device using the same are provided.

Further, an outlet connecting one plug is manufactured as a unit to facilitate the multi-outlet device constituted by two or more outlet units.

In addition, in manufacturing the multi-outlet device, the multi-outlet device that facilitates manufacturing by simplifying a structure is provided.

DESCRIPTION OF REFERENCE NUMERALS

Figure 1:
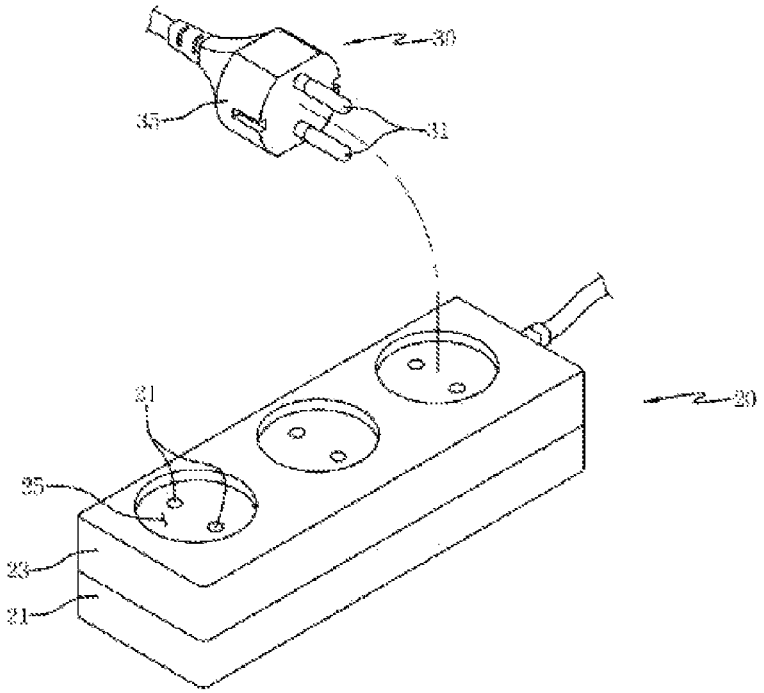
FIG. 1 is a diagram illustrating a configuration of a general outlet.

1: Multi-outlet device 100: Body case
110: Upper case 120: Lower case
200: Outlet unit 210: Upper body
212: Bottom surface plate 220: Lower body
230: Separation plate 241: Push button
242: Operating lever 243: Plate contact portion
244: Push contact portion 245: Pivot axis portion
246: Ground through-hole 250: Ground member

BEST MODE FOR CARRYING OUT THE INVENTION

The present invention is implemented by an outlet unit facilitating plug separation, including: an outlet main body having a plug inlet into which a plug is to be inserted, a bottom surface plate forming the bottom surface of the plug inlet and having a pair of terminal ports formed on the plate surface such that the terminals of a plug may be inserted, and a pair of electrodes which are disposed in the lower portion of the bottom surface plate and with which the terminals of the plug connect; a separation plate in which a pair of plug through-holes, through which the terminals of the plug pass, are formed on the plate surface and which is disposed in a raisable manner in the plug inlet so as to be capable of moving between a connection position, in which the terminals of the plug are lowered so as to be capable of being connected to the electrodes through the plug through-holes and the terminal ports, and a connection release position, in which the plug is lifted such that the terminals of the plug are separated from the electrodes; and a separation operation module which lifts the separation plate to the connection release position according to a user operation when the separation plate is placed in the connection position.

Mode for Carrying Out the Invention

Hereinafter, embodiments of the present invention will be described in detail with reference to the accompanying drawings.

Figure 2:
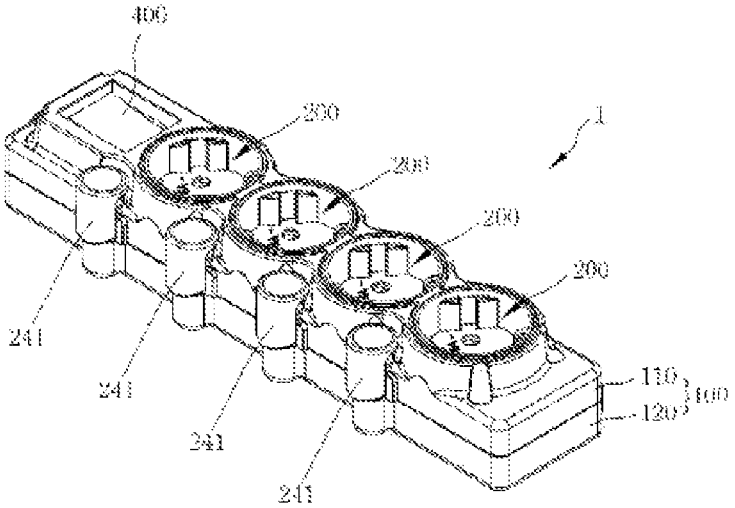
FIG. 2 is a perspective view of a multi-outlet device according to the present invention.
Figure 3:
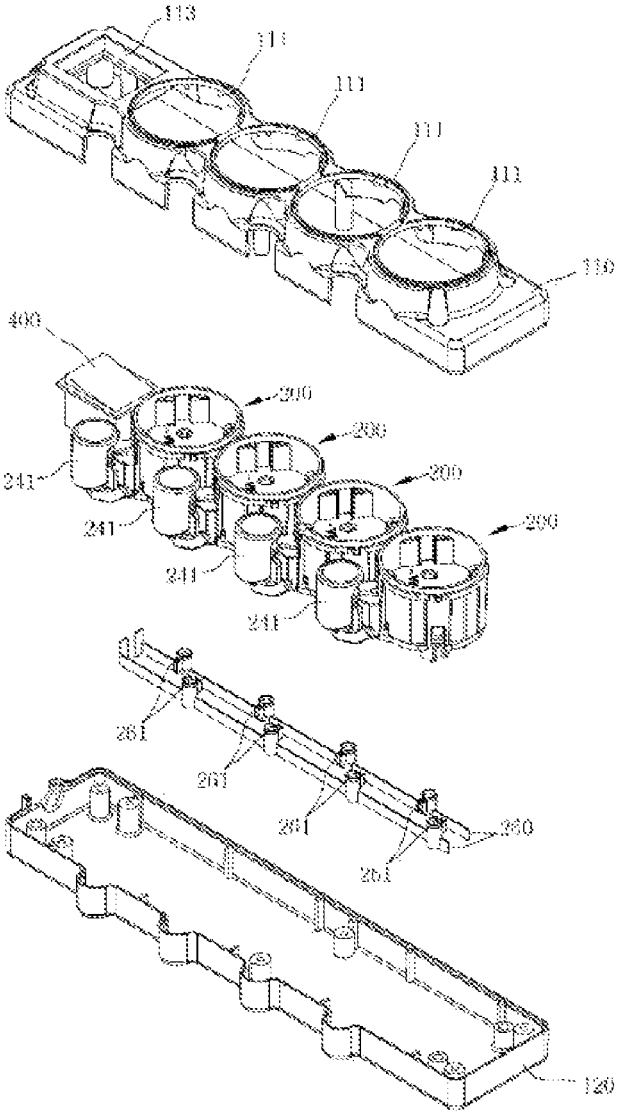
FIG. 3 is an exploded perspective view of the multi-outlet device of FIG. 2.

FIG. 2 is a perspective view of a multi-outlet device 1 according to the present invention. FIG. 3 is an exploded perspective view of the multi-outlet device 1 of FIG. 2. Referring to FIGS. 2 and 3, the multi-outlet device 1 includes a plurality of outlet units 200 and a body case 100 accommodating the same. Herein, the body case 100 includes an upper case 110 and a lower case 120.

Plugs are inserted into the plurality of outlet units 200, respectively to supply power from the outside to the plug through each outlet unit 200. Herein, the plurality of outlet units 200 are accommodated in the upper case 110 and the lower case 120 while the plurality of outlet units 200 are independently separated from each other. In FIGS. 2 and 3, four outlet units 200 are accommodated in the upper case 110 and the lower case 120 as an example.

Figure 4:
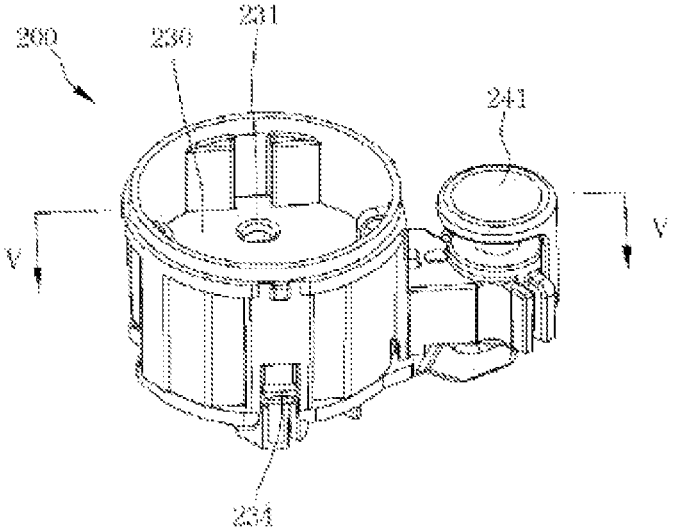
FIG. 4 is a perspective view of an outlet unit according to the present invention.
Figure 5:
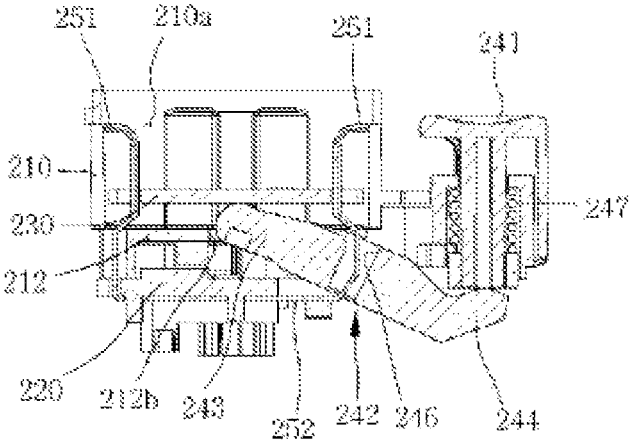
FIG. 5 is a cross-sectional view taken along line V-V of FIG. 4.
Figure 6:
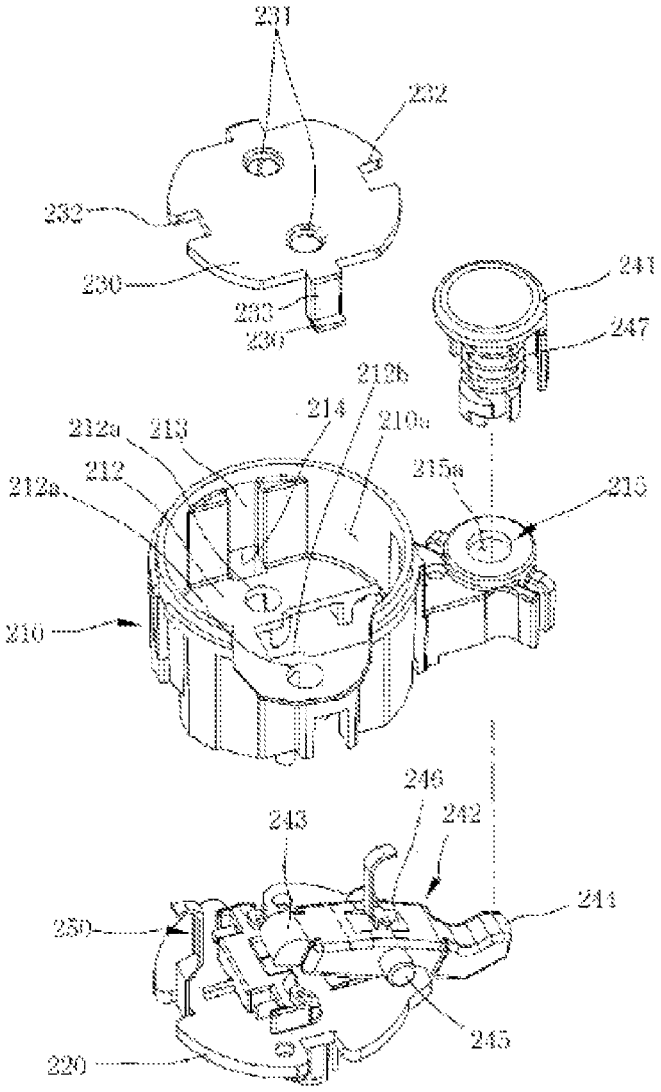
FIG. 6 is an exploded perspective view of the outlet unit of FIG. 4.

Hereinafter, the outlet unit 200 according to the present invention will be described in detail with reference to FIGS. 4 to 6. FIG. 4 is a perspective view of the outlet unit 200 according to the present invention. FIG. 5 is a cross-sectional view taken along line V-V of FIG. 4. FIG. 6 is an exploded perspective view of the outlet unit 200 of FIG. 4.

Referring to FIGS. 4 to 6, the outlet unit 200 according to the present invention includes outlet bodies 210 and 220, a separation plate 230, and a separation operation module.

The outlet bodies 210 and 220 include basic components for the outlet unit 200 to supply power through insertion of the plug. In more detail, the outlet bodies 210 and 220 include a plug insertion hole 214, a bottom surface plate 212, and a pair of electrodes 261. Herein, the outlet bodies 210 and 220 according to the present invention include an upper body 210 and a lower body 220 as an example.

The plug insertion hole 214 and the bottom surface plate 212 are formed in the upper body 210. The plug is inserted into the plug insertion hole 214, and an internal shape of the plug insertion hole 214 has an external shape of the plug, that is, a shape in which a standardized plug may be inserted.

The bottom surface plate 212 forms the bottom of the plug insertion hole 214. In addition, a pair of terminal holes 212*a* into which terminals of the plugs are inserted are formed on a plate surface of the bottom surface plate 212, and as a result, the terminals of the plug passing through the terminal hole 212*a* are connected to a pair of electrode 261 positioned below the bottom surface plate 212.

The lower body 220 is coupled to a lower part of the upper body 210. In addition, a pair of electrodes 261 are installed at positions corresponding to the terminal hole 212*a* of the bottom surface plate 212, and as a result, the terminals of the plug passing through the terminals holes 212*a* may be connected to a pair of electrode 261 positioned therebelow at he time of inserting the plug. Herein, a structure of a pair of electrodes 261 according to the present invention will be described below in detail.

Meanwhile, the separation plate 230 is installed in the plug insertion hole 214 to face the bottom surface plate 212. In addition, a pair of plug through-holes 231 through which the terminals of the plug are formed on a plate surface of the separation plate 230. As a result, when the plug is inserted into the plug insertion hole 214, the terminal of the plug is connected to the electrode 261 positioned below the bottom surface plate 212 through the plug through-hole 231 and the terminal hole 212*a* of the bottom surface plate 212.

Further, the separation plate 230 is installed in the plug insertion hole 214 to be elevatable. In more detail, the separation plate 230 is installed to be elevatable between a connection position and a connection release position in the plug insertion hole 214.

Herein, the connection position of the separation plate 230 corresponds to a position where the plug is inserted into the plug insertion hole 214, and as a result, the terminal of the plug moves down to be connected to the electrode 261 through the plug through-hole 231 and the terminal hole 212*a*. In addition the connection release position of the separation plate 230 corresponds to a position where the plug is elevated so as to separate the terminal of the plug from the electrode 261.

In the present invention, a pair of elevation guide bars 233 that extend downward from the separation plate 230, elevation guide grooves 213 that guide elevation of a pair of elevation guide bars 233 are provided on inner wall surfaces of the plug insertion hole 214 of the upper body 210, and the separation plate 230 is separated while the elevation guide bars 233 are inserted into the elevation guide grooves 213 at the time of elevating the separation plate 230, and as a result the elevation of the separation plate 230 is guided, as an example.

Further, when a suspension jaw portion 234 is formed at a lower edge of the elevation guide bar 233 and the elevation guide bar 233 is elevated at a predetermined height, the suspension jaw portion is suspended on a suspension groove 214 formed in the elevation guide groove 213 to prevent the separation plate 230 from being separated upward from the plug insertion hole 214.

Through the configuration, when a user inserts the plug into the plug insertion hole 214, the separation plate 230 moves down to the connection position and the terminal of the plug is thus connected to the electrode 261 and when the user operates the separation operation module by a method to be described below in order to separate the plug from the outlet unit 200, the separation plate 230 moves up to the connection release position and the plug is thus separated from the plug insertion hole 214, and as a result, the user may easily separate the plug.

The separation operation module moves up the separation plate 230 to the connection release position through an operation by the user while the separation plate 230 is positioned at the connection position to separate the plug from the plug insertion hole 214.

Herein, the separation operation module according to the present invention includes an operating lever 242 and a push button 241 as illustrated in FIGS. 5 and 6.

The operating lever 242 is pivotably installed in the outlet bodies 210 and 220. In more detail with reference to FIGS. 5 and 6, the operating lever 242 may include a plate contact portion 243, a pivot axis portion 245, and a push contact portion 244.

The plate contact portion 243 is provided at one edge region of the operating lever 242 to contact the bottom of the separation plate 230. In addition, the push contact portion 244 is provided at an opposite side of the plate contact portion 243 with the other edge region of the operating lever 242, that is, the pivot axis unit 245 interposed therebetween to contact the bottom of the push button 241.

Herein, the pivot axis portion 245 is provided between the plate contact portion 243 and the push contact portion 244 and the operating lever 242 is installed in the outlet bodies 210 and 220 to be pivotable on the pivot axis portion 245. In the present invention, the pivot axis portion 245 of the operating lever 242 is pivotably installed between the upper body 210 and the lower body 220 of the outlet bodies 210 and 220 as an example and a pivot axis supporting unit that axially-rotatably supports the pivot axis portion 245 is formed at any one side of the upper body 210 and the lower body 220.

The push button 241 is elevatably installed in the outlet bodies 210 and 220. In the present invention, a button supporting unit 215 that supports elevation of the push button 241 is provided in the upper body 210 of the outlet bodies 210 and 220 as an example.

Herein, the button supporting unit 215 has a button insertion hole 215*a* into which the push button 241 is inserted, and as a result, the bottom of the push button 241 contacts the push contact portion 244 of the operating lever 242 and the top of the push button 241 is exposed to the top of the button supporting unit 215 through a button insertion hole 215*a*.

In addition, the push button 241 moves down the push contact portion 244 so as for the plate contact portion 243 to move up the separation plate 230 in a connection release direction. In more detail, while the plug is inserted into the plug insertion hole 214, that is, the separate plate 230 is positioned at the connection position, when the user moves down the push button 242 by pushing the push button 241 to move down the push contact portion 244, the operating lever 242 pivots on the pivot axis portion 245, and as a result, the plate contact portion 243 positioned at an opposite side of the push contact portion 244 moves up. In this case, the plate contact portion 243 moves up the separation plate 230 in the connection release direction, and as a result, the separation plate 230 is inserted from the plum insertion hole 214.

Herein, a lever through-hole 212*b* is formed on the bottom surface plate 212, through which the plate contact portion 243 passes so that the plate contact portion 243 of the operating lever 242 positioned therebelow contacts the bottom of the separation plate 230 positioned thereabove.

According such a configuration, the user may easily separate the plug coupled to the outlet unit 200 only by pushing the push button 241. Further, the separation plate 230 pushes up the entirety of the surface of the plug by operating the push button 241 to more stably separate the plug.

Herein, an elastic member 247 that presses the push button 241 in a move-up direction is installed in the button supporting unit 215 as illustrated in FIG. 5 as an example. As a result, the separation plate 230 is positioned at the connection position by elastic force of the elastic member 247 even while the plug is not inserted and even after the user separates the plug by pushing the push button 241 after the plug is inserted, the separation plate 230 moves to the connection position and the inside of the plug insertion hole 214 has a general outlet shape.

Meanwhile, the outlet unit 200 according to the present invention includes a ground member 250 that grounds the plug at the time of connecting the plug. Herein, the ground member 250 may include a pair of ground portions 251 exposed to an inner wall surface of the plug insertion hole 214 to ground the plug. In addition, a pair of ground portions 251 are connected below the bottom surface plate 212 by a connection portion 252. That is, in the ground member 250 according to the present invention, a pair of ground portions 251 and the connection portion 252 are integrally formed.

Figure 7:
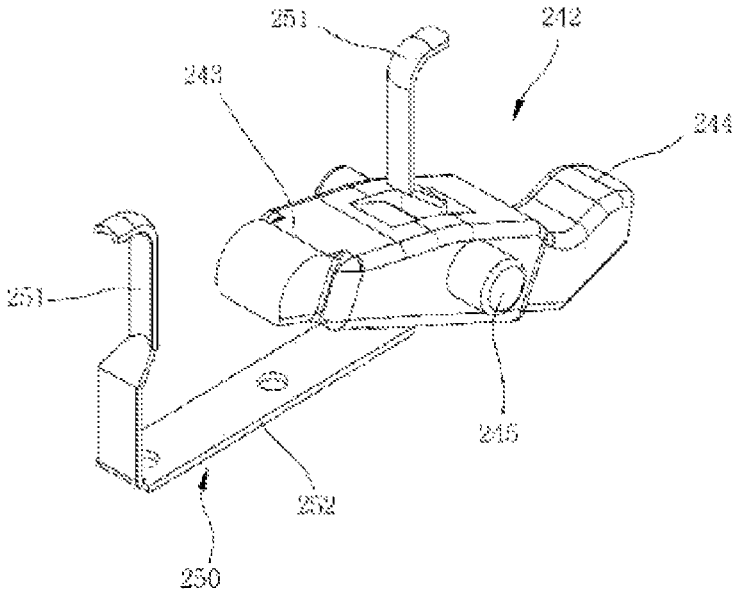
FIG. 7 is a diagram for describing a coupling relationship between an operating lever and a ground member of the outlet unit according to the present invention.

In addition, the connection portion 252 extends in the longitudinal direction of the operating lever 242 as illustrated in FIG. 5 and a ground through-hole 246 through which any one of a pair of ground portions 251 passes is formed in the operating lever 242 as illustrated in FIG. 7.

As a result, when the connection portion 252 extends in the longitudinal direction of the operating lever 242 while the connection portion 252 is positioned below the bottom surface plate 212, one ground portion 251 extends to the top of the bottom surface plate 212 through the ground through-hole 246 of the operating lever 242 positioned above the connection portion 252 to be exposed to an inner wall of the plug insertion hole 214.

Herein, a first ground through-hole 232 and a second ground through-hole (not illustrated) through which the ground portion 251 passes are, of course, formed on the bottom surface plate 212 and the separation plate 230, respectively so as for a pair of ground portions 251 to extend to the inside of the plug insertion portion 214. In FIG. 6, the first ground through-hole 232 is recessed in the separation plate 230 in an inner direction of the plate surface as an example.

Figure 8:
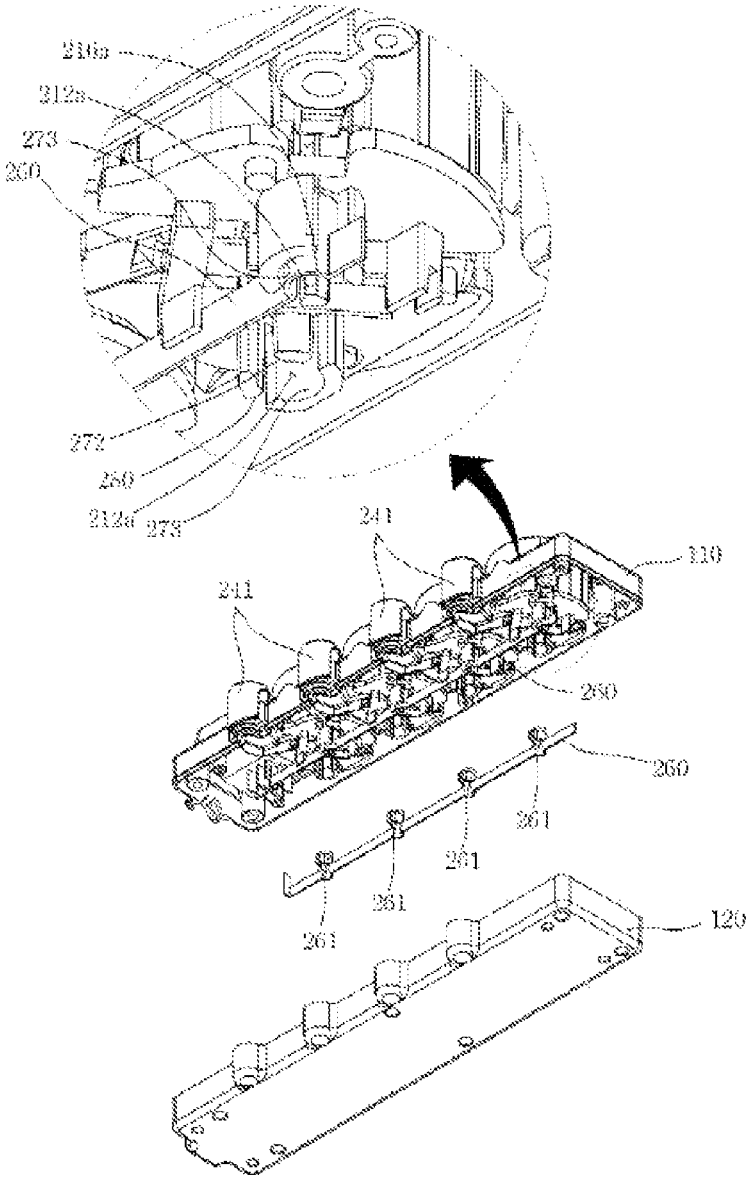
FIGS. 8 and 9 are diagrams for describing an example of a configuration in which an electrode is installed below a bottom surface plate in the multi-outlet device according to the present invention.
Figure 9:
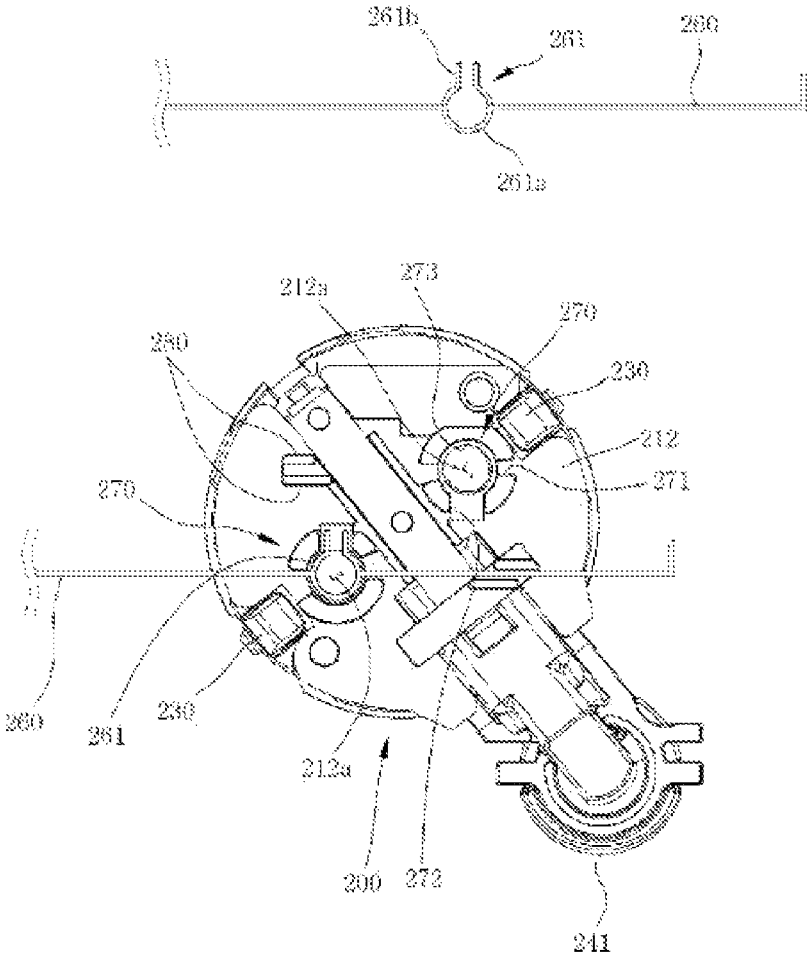

Meanwhile, a pair of electrodes 261 applied to the respective outlet units 200 are installed below the bottom surface plate 212. FIGS. 8 and 9 are diagrams for describing an example of a configuration in which the electrode 261 is installed below the bottom surface plate 212 in the multi-outlet device 1 according to the present invention.

Referring to FIGS. 8 and 9, the multi-outlet device 1 includes a pair of power line members 260. The power line members 260 are installed to face each other below the respective bottom surface plates 212 of the plurality of outlet units 200 in an installation direction of the outlet unit 200. In addition, a pair of electrodes 261 to be applied to each outlet unit 200 are formed in a pair of power line members 260, respectively.

Herein, each outlet unit 200 may include a pair of electrode coupling portions 270 provided below the bottom surface plate 212 and coupled with a pair of electrodes 261, respectively, as illustrated in FIGS. 8 and 9.

Each electrode 261 may include a cylindrical electrode connection portion 261*a* and a pair of electric coupling portions 261*b* as illustrated in FIG. 9. While the electrode connection portion 261*a* is inserted into the electrode coupling portion 270, the terminal of the plug is inserted to be electrically connected. In addition, a pair of elastic coupling portions 261*b* extend to face each other outward in the radial direction from the electrode connection portion 261*a*.

In the present invention, a part of a cylindrical shape of the electrode connection portion 261*a* is cut and each of a pair of elastic coupling portion 261*b* extends outward in the radial direction from a cut region as an example.

In addition, each electrode coupling portion 270 of the outlet unit 200 may include an electrode insertion hole 273 and a coupling cut portion 272. The electrode insertion hole 273 has a cylindrical inner diameter so that the electrode connection portion 261*a* is inserted into the electrode hole 273 as illustrated in FIG. 9. In addition, the coupling cut portion 272 is formed by cutting one region of the electrode insertion hole 273 and when the electrode connection portion 261*a* is inserted into the electrode insertion hole 273, the coupling cut portion 272 elastically fits in a pair of electrode insertion hole 273.

According to such a configuration, a pair of electrodes 261 for supplying power to the plurality of outlet units 200 are formed in a pair of power line members 260, the electrode connection portion 261*a* of the each electrode 261 is inserted into the electrode insertion hole 273 of the electrode coupling portion 270 to be electrically connected with the terminal of the plug through the terminal hole 212*a* formed on the bottom surface plate 212, and a pair of elastic coupling portions 261*b* constituting the electrode 261 elastically fits in the coupling cut portion 272, and as a result, a pair of electrodes 261 may be coupled to lower parts of the plurality of outlet units 200 as illustrated in FIG. 8.

Herein, the electrode coupling portion 270 may include a line cutting portion 271 formed by cutting one region of the electrode insertion hole 273. The power line member 260 is inserted into the line cutting portion 271 when the electrode connection portion 261*a* is inserted into the electrode insertion hole 273, and as a result, the electrode coupling portion 270 may be inserted into the electrode insertion hole 273.

Further, a line insertion portion 280 in which the power line member 260 fits may be formed below the bottom surface plate 212 so that the power line member 260 is more stably positioned below each outlet unit 200.

Referring back to FIGS. 2 and 3, the multi-outlet device 1 according to the present invention will be described.

Unit exposure holes 111 through which each outlet unit 200 is exposed to the top are formed in the upper case 110 to correspond to the plurality of outlet units 200 as illustrated in FIG. 3. In addition, the lower case 120 is coupled with the upper case 110 with the respective outlet units 200 interposed therebetween to accommodate and support the plurality of outlet units 200.

In addition, undescribed reference number 400 of FIGS. 2 and 3 represents a power switch that controls whether to supply power to the multi-outlet device 1 and reference numeral 133 represents a switch exposure hole formed in the upper case 110 and exposing the power switch 400 to the upper case 110.

Figure 10:
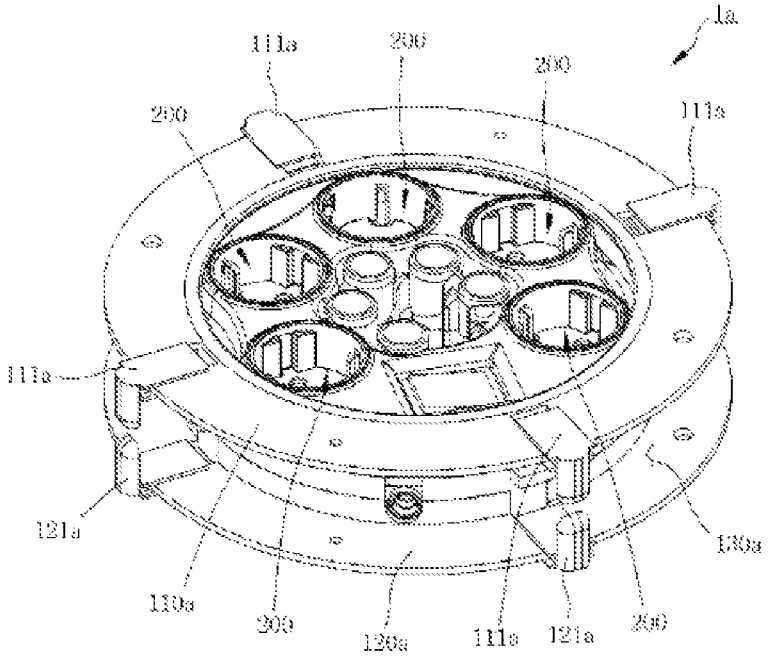
FIG. 10 is a perspective view of a multi-outlet device according to another embodiment of the present invention.

FIG. 10 is a diagram illustrating an example of a multi-outlet device 1*a* according to another embodiment of the present invention. In the multi-outlet device 1*a* illustrated in FIG. 10, the plurality of outlet units 200 are arranged in a circular shape as an example.

In addition, outer diameters of the upper case 110*a* and a lower case 120*a* are provided in the circular shape as an example. Herein, a cable winding unit 130*a* for winding a power cable is provided along the outer diameters of the upper case 110*a* and the lower case 120*a* in the multi-outlet device 1*a* as an example.

As a result, when the length of the power cable for supplying power to the multi-outlet device 1 is provided to be long, the corresponding power cable is kept to be wound on the cable winding portion 130*a* and the power cable is released as long as a required length to be used.

Herein, cable pressing portions 111*a* and 121*a* installed to move inward and outward in the radial direction may be provided in the upper case 110*a* and the lower case 120*a*. The cable pressing portions 111*a* and 121*a* press the power cable wound on the cable winding portion 130*a* inward in the radial direction to prevent the power cable from being separated from the cable winding portion 130*a*.

In FIG. 10, four cable pressing portions 111*a* and 121*a* are installed in each of the upper case 110*a* and the lower case 120*a* outward in the radial direction as an example, but the configuration of the cable pressing portions 111*a* and 121*a* are not limited to the number of the cable pressing portions 111*a* and 121*a*, of course. Herein, the cable pressing portions 111*a* and 121*a* may be provided at only at any one side of the upper case 110*a* and the lower case 120*a*, of course.

Although some embodiments of the present invention have been illustrated and described, those skilled in the art can know that modification of the embodiment can be made without departing from the principle or spirit of the present invention. The scope of the present invention will be determined based on the appended claims and equivalents thereto.

Industrial Applicability

The present invention is used to connect plugs of a plurality of electronic in connection with outlets installed in homes, companies, other places.

What is claimed is:

1. An outlet unit facilitating plug separation comprising:

an outlet main body having a plug inlet into which a plug is to be inserted, a bottom surface plate forming the bottom surface of the plug inlet and having a pair of terminal ports formed on the plate surface such that the terminals of a plug may be inserted, and a pair of electrodes which are disposed in the lower portion of the bottom surface plate and with which the terminals of the plug connect;

a separation plate in which a pair of plug through-holes, through which the terminals of the plug pass, are formed on the plate surface and which is disposed in a raisable manner in the plug inlet so as to be capable of moving between a connection position, in which the terminals of the plug are lowered so as to be capable of being connected to the electrodes through the plug through-holes and the terminal ports, and a connection release position, in which the plug is lifted such that the terminals of the plug are separated from the electrodes; and a separation operation module which lifts the separation plate to the connection release position according to a user operation when the separation plate is placed in the connection position.

2. The outlet unit facilitating plug separation of claim 1, wherein:

the separation operation module includes an operating lever having a plate contact portion contacting the bottom surface of the separation plate, a pivot axis portion pivotably installed in the outlet body, and a push contact portion at an opposite side to the plate contact portion with the pivot axis portion interposed therebetween, and a push button elevatably installed in the outlet body and pivoting the operating lever on the pivot axis portion by moving down the push contact portion so as for the plate contact portion to move up the separation plate in the connection release direction.

3. The outlet unit facilitating plug separation of claim 2, further comprising:

a ground member grounding the plug at the time of connecting the plug, wherein the ground member has a pair of ground portions exposed to an inner wall surface and to which the plug is grounded and a connection portion connecting the pair of ground portions below the bottom surface plate which are integrally formed in the plug through-hole.

4. The outlet unit facilitating plug separation of claim 3, wherein:

the connection portion extends in the longitudinal direction of the operating lever and a ground through-hole through which any one of the pair of ground portions passes is vertically formed in the operating lever.

5. The outlet unit facilitating plug separation of claim 2, wherein:

a lever through-hole through which the plate contact portion passes is formed on the bottom surface plate so that the plate contact portion of the operating lever contacts the bottom of the separation plate.

6. The outlet unit facilitating plug separation of claim 2, wherein:

the outlet body includes an upper body configured to include the plug through-hole and the bottom surface plate, and a lower body coupled to a lower portion of the upper body, and the pivot axis portion of the operating lever is pivotably installed between the upper body and the lower body.

7. The outlet unit facilitating plug separation of claim 6, further comprising:

a pair of elevation guide bars that extend toward the bottom surface plate from the separation plate; and an elevation guide grooves formed on the inner wall surface of the plug through-hole of the upper body and guiding elevation of the pair of elevation guide bars when the separation plate is elevated.

8. The outlet unit facilitating plug separation of claim 7, further comprising:

a suspension jaw portion provided at a lower edge area of the elevation guide bar; and a suspension groove formed at the elevation guide groove and on which the suspension jaw portion is suspended so as to prevent the separation plate from being separated to an upper portion of the plug through-hole when the elevation guide bar is elevated.

9. A multi-outlet device facilitating plug separation comprising:

a plurality of outlet units of claim 1;

an upper case having unit exposure holes through which the respective outlet units are exposed to the upper portion to correspond to the plurality of outlet units; and a lower case coupled with the upper case with being interposed among the plurality of outlet units to accommodate and support the plurality of outlet units, wherein a pair of electrodes applied to the respective outlet units are installed on a plate surface of the lower case.

10. The multi-outlet device facilitating plug separation of claim 9, further comprising:

a pair of power line members installed in an installation direction of the plurality of outlet units to face the lower portions of the bottom surface plates of the plurality of outlet units, wherein the pair of electrodes to be applied to each outlet unit are formed in the pair of power line members, respectively.

11. The multi-outlet device facilitating plug separation of claim 10, wherein:

each outlet unit further includes a pair of electrode coupling portions provided at the lower portion of the bottom surface plate and coupled with the pair of electrodes, respectively.

12. The multi-outlet device facilitating plug separation of claim 11, wherein:

each electrode includes a cylindrical electrode connection portion into which a terminal of the plug is inserted and which is electrically connected with the terminal of the plug while being inserted into the electrode insertion portion, and a pair of elastic coupling portions extending outward in a radial directon from the electrode connection portion to face each other, and each electrode coupling portion includes an electrode insertion hole having a cylindrical inner diameter, into which the electrode connection portion is inserted, and a coupling cutting portion formed by cutting one area of the electrode insertion hole and elastically engaged in the pair of electrode insertion holes when the electrode connection portion is inserted into the electrode insertion hole.

13. The multi-outlet device facilitating plug separation of claim 12, wherein:

each electrode coupling portion further includes a line cutting portion formed by cutting one area of the electrode insertion hole, into which the power line member is inserted when the electrode connection portion is inserted into the electrode coupling hole.

14. The multi-outlet device facilitating plug separation of claim 9, wherein:

the plurality of outlet units are disposed in a circular pattern, outer diameters of the upper case and the lower case are provided in the circular pattern, and a cable winding portion for winding a power cable is provided along the outer diameters of the upper case and the lower case.

15. The multi-outlet device facilitating plug separation of claim 14, further comprising:

at least one cable pressing portion installed at least on one side of the upper case and the lower case to move inward and outward in the radial direction to press the power cable wound on the cable winding portion inward the radial direction.

* * * * *